US007193336B1

(12) United States Patent
Mueller et al.

(10) Patent No.: US 7,193,336 B1
(45) Date of Patent: Mar. 20, 2007

(54) SWITCHABLE LOW-LOSS CRYOGENIC LEAD SYSTEM

(76) Inventors: Otward M. Mueller, 96 Sweet Rd., Ballston Lake, NY (US) 12019; Michael J. Hennessy, 9 Patroon Pl., Ballston Lake, NY (US) 12019

( * ) Notice: Subject to any disclaimer, the term of this patent is extended or adjusted under 35 U.S.C. 154(b) by 400 days.

(21) Appl. No.: 10/691,767

(22) Filed: Oct. 23, 2003

Related U.S. Application Data

(60) Provisional application No. 60/436,811, filed on Dec. 27, 2002, provisional application No. 60/420,535, filed on Oct. 23, 2002.

(51) Int. Cl.
*H01H 67/00* (2006.01)

(52) U.S. Cl. ..... 307/113; 307/147; 361/19; 505/163

(58) Field of Classification Search ..... 361/161, 361/19, 103; 307/112, 113, 131; 505/115, 505/163, 150; 174/68.2; 62/259.2
See application file for complete search history.

(56) References Cited

U.S. PATENT DOCUMENTS 3,643,185 A * 2/1972 Zimmer ..... 335/58
4,598,338 A * 7/1986 Van Devender et al. .... 361/435
4,856,297 A * 8/1989 Yasue ..... 62/51.1
4,906,861 A * 3/1990 Roy et al. ..... 307/138
5,166,776 A * 11/1992 Dederer et al. ..... 505/163
5,218,505 A * 6/1993 Kubo et al. ..... 361/19
5,250,508 A * 10/1993 Pham ..... 505/211
5,309,980 A * 5/1994 Mendeleev ..... 165/53
5,353,000 A * 10/1994 Morris et al. ..... 335/216
5,396,206 A * 3/1995 Herd et al. ..... 505/163
5,414,586 A * 5/1995 Hara et al. ..... 361/19
5,802,855 A * 9/1998 Yamaguchi et al. ..... 62/3.2
5,884,485 A * 3/1999 Yamaguchi et al. ..... 62/3.2
2004/0113268 A1* 6/2004 Shirakawa et al. ..... 257/724

FOREIGN PATENT DOCUMENTS

JP 2000243618 A * 9/2000
JP 2000294068 A * 10/2000

* cited by examiner

*Primary Examiner*—Brian Sircus
*Assistant Examiner*—Daniel Cavallari
(74) *Attorney, Agent, or Firm*—Leonard Cooper

(57) ABSTRACT

A method and apparatus for reducing conductive thermal losses in high-current cryogenic power electronics systems needing large cables to interface between warm and cold environments. Thermal losses increase with increasing cross-sectional area. The total current at the warm/cold interface is split into many smaller currents by splitting the power buss into a plurality of parallel leads. Respective physical switches in each smaller lead at the interface interrupt current flow, and at the same time open the path for thermal conduction along the lead. When little or no current is flowing through the system, selected smaller leads of the power buss are physically opened by the associated switches to stop the thermal and electrical flow along these leads. Current diverts to another parallel lead in the buss but the cross section for heat flow is reduced at the interface.

14 Claims, 4 Drawing Sheets

SWITCHABLE LOW-LOSS CRYOGENIC LEAD SYSTEM

The benefit of provisional application No. 60/420,535 filed on Oct. 23, 2002 and provisional application No. 60/436,811 filed on Dec. 27, 2002 is claimed in this application.

BACKGROUND OF THE INVENTION

In any cryogenic power electronics system involving components that must be kept at a higher temperature (e.g., room temperature), a significant source of energy loss is caused by the cables (leads) that carry electrical current from the cold to the warm environment or vice-versa. In addition to the electrical dissipative losses in the cable itself, there are heat loads to the lower temperature bath due to the cable's thermal conductivity. Heat from the warm environment leaks into the cold environment through the cable, thus placing a greater burden on the refrigeration system used to keep the cold environment at its cryogenic temperature.

SUMMARY OF THE INVENTION

This patent application provides a method and apparatus for reducing these conductive thermal losses in high-current cryogenic power electronics systems needing large cables to interface between warm and cold environments. The size of the cables is determined by the amount of current to be carried, and the cable's current-carrying capability is proportional to its cross-sectional area. Thermal losses increase with increasing cross-sectional area. Therefore, the present invention splits the total current at the warm/cold interface into many smaller currents via a power buss comprising a plurality of parallel leads. This plurality of smaller leads does not per se reduce the overall conductive thermal losses at the warm/cold interface as the sum of the smaller lead cross sections approximately equals the cross section of the large low temperature power lead. These thermal losses in the leads are reduced by means of respective physical switches which can open the associated smaller lead at the interface to interrupt current flow, and at the same time open the path for thermal conduction along the lead from the warm to the cold environment. Thus, when little or no current is flowing through the system, selected leads of the power buss are physically opened to stop the thermal and electrical flow along these leads. The current diverts to another parallel lead in the buss but the cross section for heat flow has been reduced at the interface.

The invention is not intended as a high frequency or high duty cycle circuit. Instead, it is useful where a load requires only limited periods of high current. For example, a ship motor may run at full power for several hours, and then run at only half power or be shut off entirely. Half of the leads are disconnected so that only half the leads remain, allowing the motor to run at lower speeds without placing a full heat load on the ship's refrigeration system. All of the leads may be disconnected while the ship is in port, so that the refrigeration system does not have to absorb any thermally dissipated power. The circuit of the present invention provides tremendous energy savings over the lifetime of such a vessel.

Even though the switchable leads may be copper, they may act as interfaces between a cryogenic superconducting buss contained in the cold environment and room temperature cables outside the cryogenic environment, which supply power to the load when needed.

DESCRIPTION OF PREFERRED EMBODIMENTS

Figure 4:
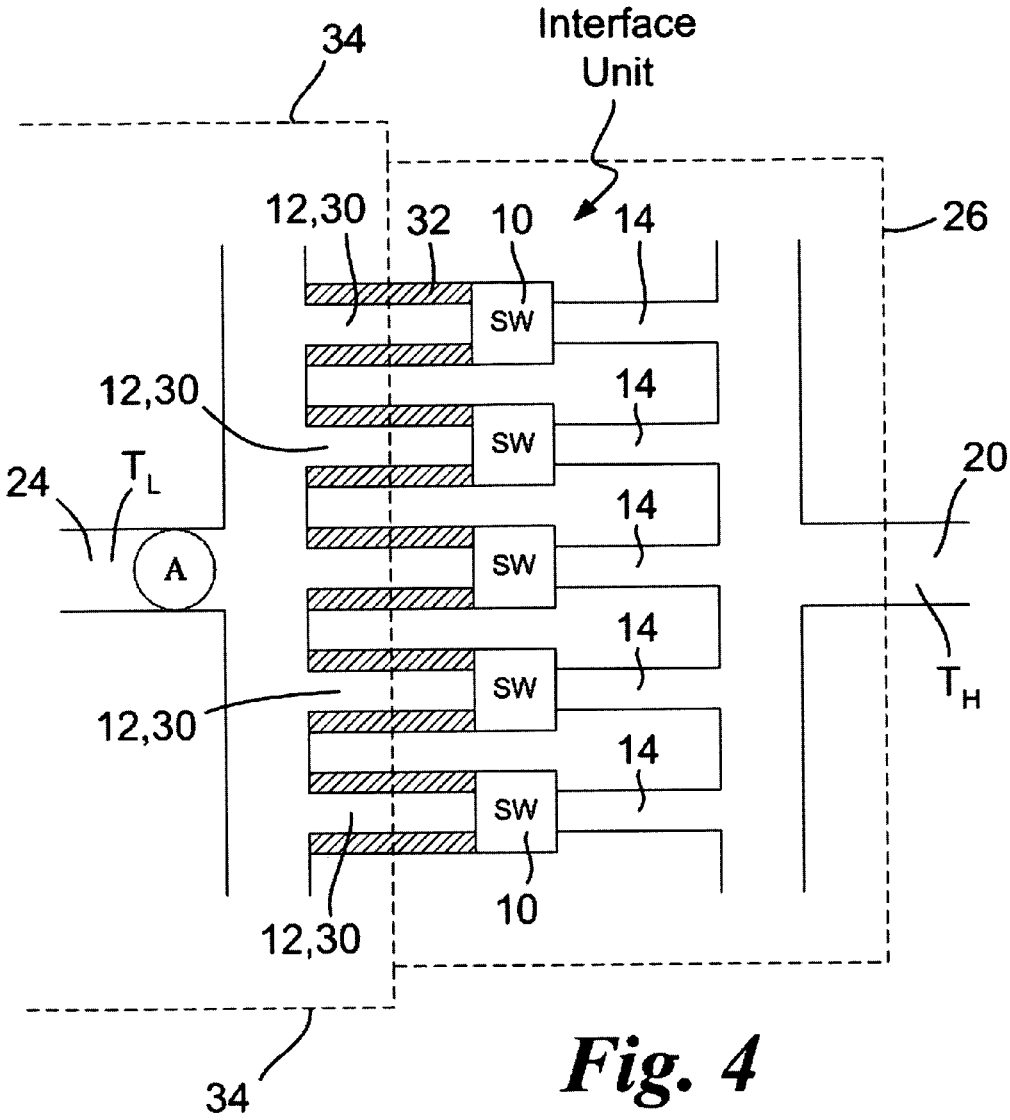
FIG. 4 is an overview of the system in accordance with the invention showing 5 branches at the temperature interface.

This patent application provides a method and apparatus for reducing the conductive thermal losses in high-current cryogenic power electronics systems needing large cables to interface between warm and cold environments. The size of the cables is determined by the amount of current to be carried, and the cable's current-carrying capability is proportional to its cross-sectional area. Thermal losses increase with increasing cross-sectional area. Therefore, the present invention splits the total current at the warm/cold interface into many smaller currents via a power buss comprising a plurality of parallel leads. This plurality of smaller leads does not per se reduce the overall conductive thermal losses at the warm/cold interface as the sum of the smaller lead cross sections approximately equals the cross section of the large low temperature power lead. These thermal losses in the leads are reduced by means of respective physical switches, each in an associated smaller lead at the interface, used to interrupt current flow, and at the same time open the path for thermal conduction along the lead from the warm to the cold environment. (FIG. 4). Thus, when little or no current is flowing through the system, selected leads of the power buss are physically opened to stop the thermal and electrical flow along these leads. The current diverts to another parallel lead in the buss but the cross section for heat flow has been reduced at the interface.

Losses due to electrical resistivity are minimized in the cryogenic system by utilizing superconducting cables at the low temperature, $T_L$. This temperature is typically 77 degrees Kelvin (77 K, liquid nitrogen) or down to 4 K (liquid helium). For the sake of an example, 77 K is used for the cold or low temperature $T_L$, and a high temperature $T_H$ of 300 K is used to represent the temperature of the warm environment in this application. However, the temperatures are not so limited in using the present invention.

The superconducting cables operating at the low temperature $T_L$ are connected near the 300K/77 K interface to conducting cables, originating at the high temperature $T_H$ and preferably made of copper, brass, or aluminum. The heat loads in the cryogenic power electronics system are reduced by physically opening portions of the power cable at this thermal interface. The switching configuration connects the minimum amount of conductor cross section required to pass the current at any given time. As more current is required of the circuit, more conductor leads are switched in. As is known in superconducting technology, when superconductive leads are used on the low temperature side, it is necessary that the critical current (amperes per square cm. of cross section) not be exceeded for the particular conductor material, operating temperature, etc. lest the conductor lose its superconductive properties.

Figure 1:
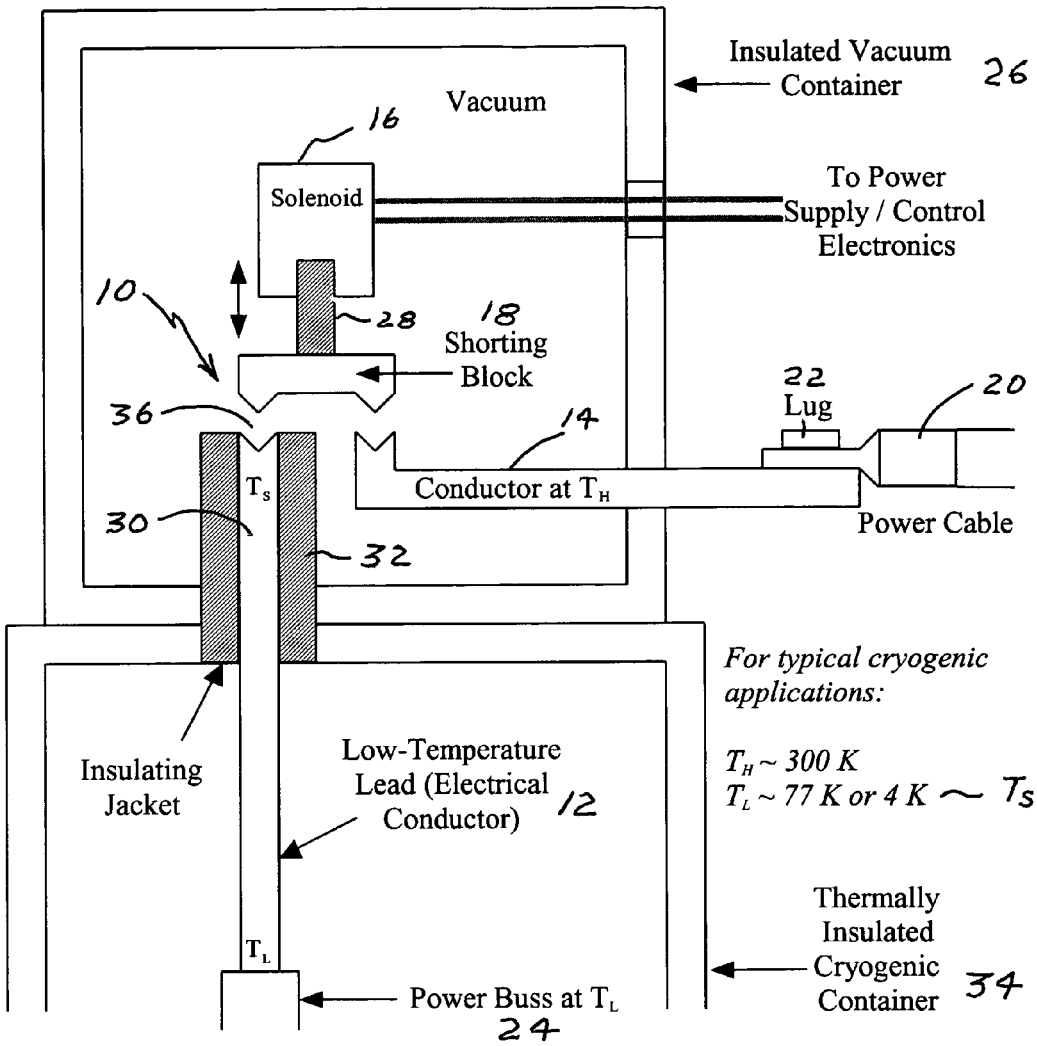
FIG. 1 illustrates the physical connection between an electrical lead at a low-temperature/high-temperature interface for electrical conduction in accordance with the invention.

FIG. 1 shows the physical switch 10 connecting the low-temperature lead 12 and high-temperature lead 14. A solenoid 16 connects the metal shorting block 18 to the low- and high-temperature leads 12, 14, in closing the switch 10 and allowing current to flow from the high-temperature lead 14 through the shorting block 18 to the low-temperature lead 12, or vice-versa. A power cable 20 connects to the high temperature lead 14 with a lug 22, and the low temperature lead 12 connects to the low temperature power buss 24. To reduce heat flow from the high temperature to the low temperature at this interface, the solenoid 16 and switch 10 are enclosed in an insulated, evacuated chamber 26; the solenoid plunger 28 is a thermal insulator. Keeping the moving elements at the high temperature allows use of standard, less costly components.

A portion 30 of the low temperature lead 12 extends through the wall of the container 26 to the switch 10. That portion 30 is thermally insulated by the jacket 32. The low temperature lead 12 and cold power buss 24 are maintained in a thermally insulated container 34.

When the switch 10 is open (as illustrated in FIG. 1), current flow at the interface between the leads 12, 14 is zero and heat transmission is reduced substantially as only radiation heat transfer can occur across the (evacuated) gap 36 between the shorting block 18 and the portion 30 of the cold lead 12 at the temperature $T_S$ that is close to the temperature $T_L$. Conduction and convection heat transfer are eliminated. A further reduction in radiation heat transfer can be achieved by a radiation shield (not shown), e.g. with reflective surfaces separated by thermal insulation, that is inserted mechanically, for example by interconnection with the moving elements 18, 28, into the gap 36 when the switch 10 opens, and vice versa.

Figure 2:
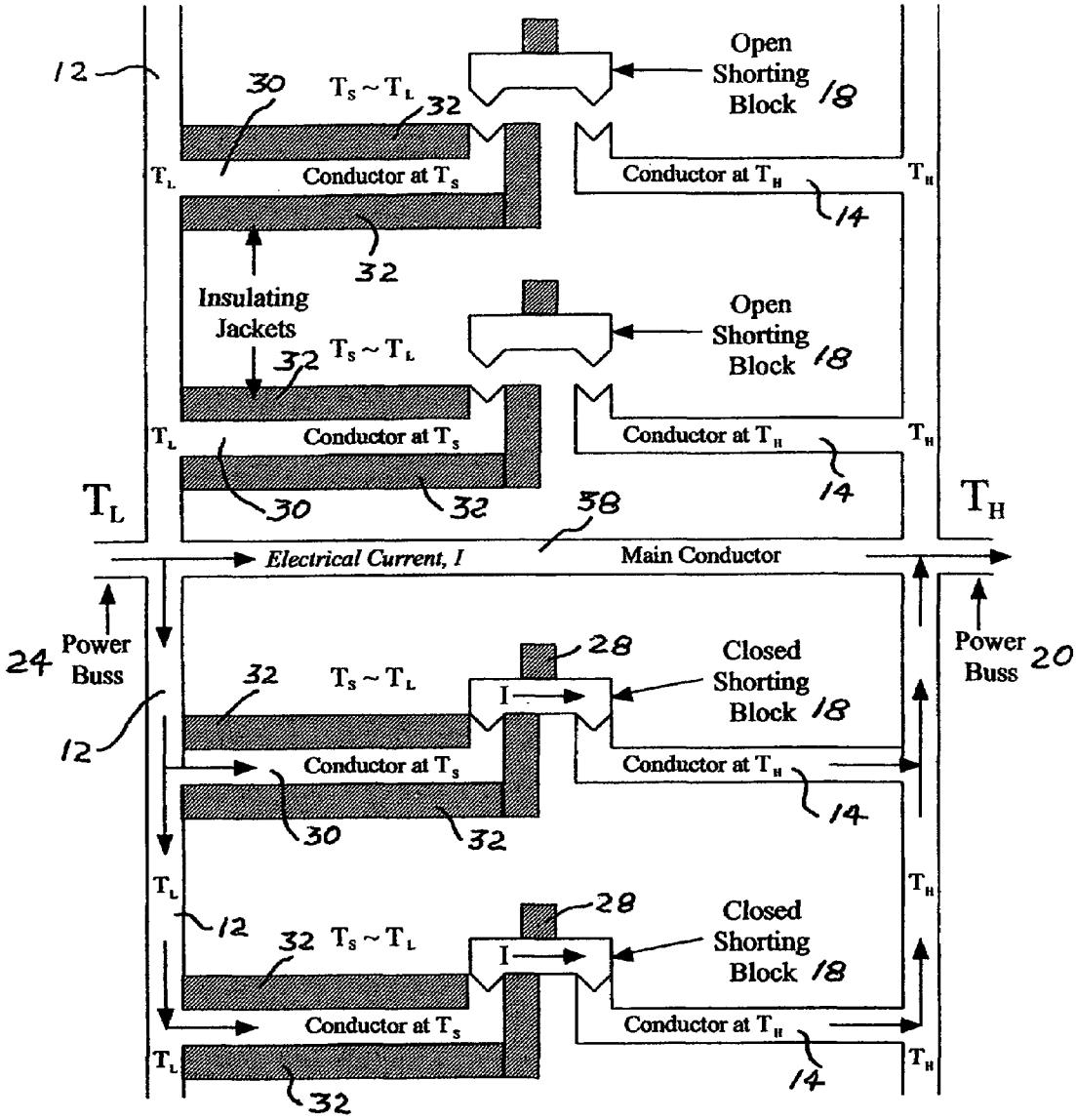
FIG. 2 shows connected and disconnected leads in a buss to minimize thermal conduction in accordance with the invention when a fraction of the maximum circuit current is required.

In cases where the current is reduced, but not turned off completely, a configuration similar to that shown in FIG. 2 is used. Here, a main conductor 38 carries some current between the power busses 20, 24 at all times, and other smaller cross section parallel-connected conductors 12,14 are switched on selectively by a respective mechanism 10,16,18,28 described in FIG. 1 when higher currents are needed. Basically, the leads 20, 24 split into n smaller conductors, each of which carries 1/n of the total current when all switches 10 are closed. (FIG. 4). However, the current-carrying capability of each parallel lead path may be determined by its cross-sectional area and the resistivity of the material of which it is made.

It is inherent in electrical circuitry that when there is a quantity of n electrical elements in parallel, the numerical value of n is at least 2.

The main conductor 38, without an interrupting switch, serves as a fixed short circuit to prevent voltage spikes across the switch contacts during inductive switching, and to keep the voltage from arcing when the switches are opened. This main conductor 38 may not be necessary in all situations. For ultra-low-thermal loss applications, the main conductor 38 may be eliminated. (FIG. 4) Thus, in periods where no current is needed, the conductive thermal flow from the warm cable 20 to the low-temperature environment can be interrupted completely at the interface by opening all switches 10.

FIG. 2 illustrates electrical current flowing from the low temperature buss 24 to the high temperature buss 20. However, the current could flow in either direction. On the other hand, conductive heat flow is always from high to low temperature, that is opposite to the directions of the current arrows shown in FIG. 2.

Figure 3:
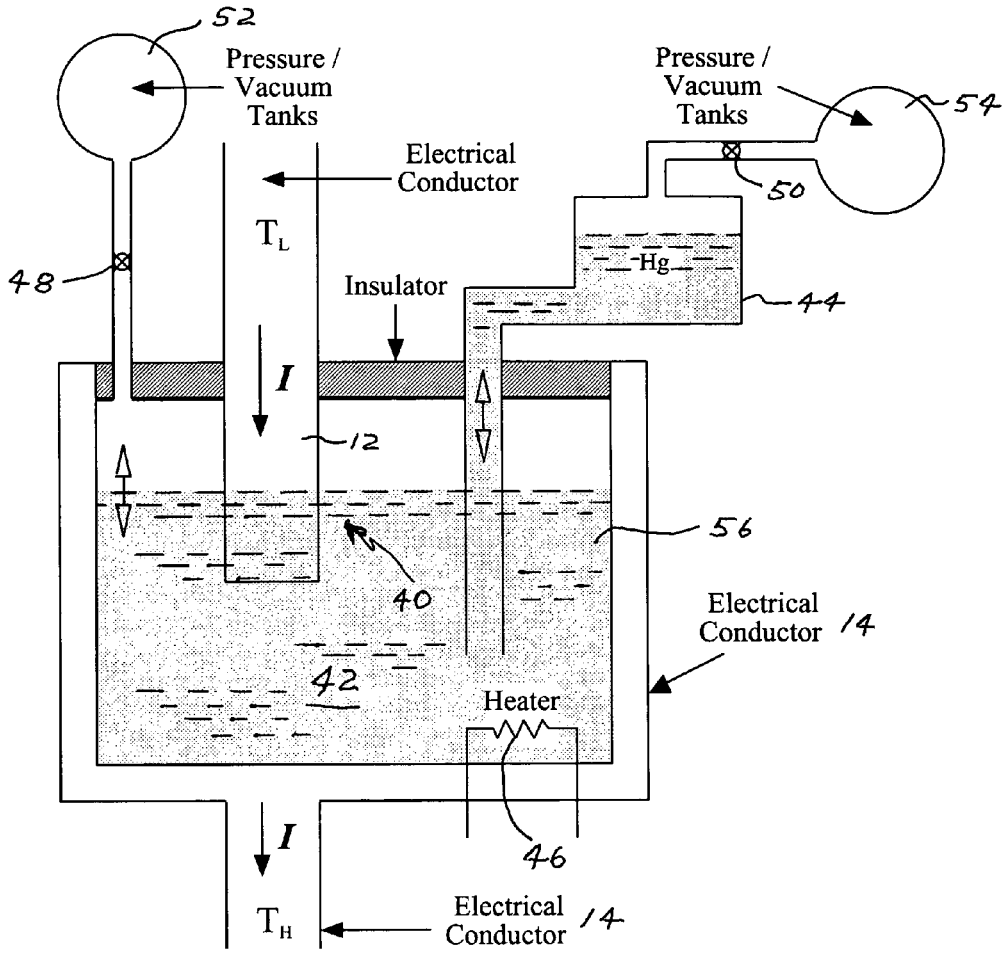
FIG. 3 is a mercury-based switch used in accordance with the invention to selectively disrupt thermal conductivity and heat loss in a lead in a cryogenic power electronics system.

The physical switch 10 of FIG. 1 can be replaced, in an alternative embodiment of the invention, by another construction for disrupting the thermal conduction between the high- and low-temperature leads 12, 14. In FIG. 3, a mercury-type switch 40 is used to disable the heat flow. As illustrated, the warm and cold leads 12, 14 are connected by a bath 42 of molten mercury, which is supplied from a reservoir 44. When there is to be no current flow through the interface, the mercury level is lowered until there is no contact between the cold lead 12 and the mercury 42. The mercury 42 is lowered to disrupt the thermal and electrical pathways by first heating the mercury (if it has solidified) with the heater 46, and then by transporting the molten mercury using valves 48, 50, and pressure/vacuum tanks 52, 54. This construction insures exceptionally good contact between leads. Mercury wetted solenoid relays may also be used in this application.

As illustrated in FIG. 3, the switch is in the closed state at the high/low temperature interface; current can flow through the mercury from the low temperature lead 12 to the high temperature lead 14. To open the circuit at the interface, the valves 48, 50 are opened and pressure is increased in tank 52. This causes mercury to flow from the container 56 into the reservoir 44 until a gap is created between the leads 12, 14 and current flow and conductive heat transfer are interrupted. The valves 48, 50 are then closed.

There are many alternative modes of operation to change the state of the mercury switch (FIG. 3). For example, pressure may be reduced in the tank 54 to lower the mercury level. As the manner of operating the liquid conductor switch is not considered to be a novel feature of the present invention, a further detailed description is not provided herein.

The concept of the mercury based switch of FIG. 3 is also achieved using other metals or electrically conductive materials that are liquid at or near room temperature, for example, gallium, cesium, and rubidium.

It will be apparent that a plurality of low temperature conductors can enter the mercury vessel 56 (FIG. 3) with different extension toward the high temperature conductor. The connection of several parallel current paths can be controlled by stepwise control of the depth of the mercury in a single apparatus. Linear actuators and rotational actuators can also be applied to provide stepwise control over many parallel current paths at the temperature interface using a single mechanical device.

In the above discussion and description, the busses were divided into n parallel leads and the sum of the cross-sections of the n parallel leads approximately equaled the cross-section of the buss feeding the n parallel leads. The basic concept of the present invention reduces the cross-sectional flow area for current in proportion to the quantity of electrical current flowing between the high and low temperature busses. The above described arrangement accomplishes this result and secures the benefit of reduced conductive heat flow with each reduction of current and its corresponding reduction in cross-sectional current flow area.

It should be understood that the same result can be achieved when the n branches have many different current cross-sections. One lead has cross section A. Other lead cross sections are less than the area A. Cross-sections progressively decrease in the leads so that it is only necessary to select the proper lead(s) to accommodate each narrow range of current flow as it occurs in the busses. Thus, the sum of the cross-sections of the n leads may easily exceed the area A but the system in accordance with the invention never operates in that condition. Operation can be through a single lead having a cross-section equal to or less than A while all of the other leads are open circuited including a physical gap at the temperature interface which interrupts conductive heat flow. In, for example, a solenoid switched system, only one solenoid need be energized at a time.

This alternative variation is considered to fall within the scope of the present invention.

The above-described circuits would normally be used for switching loads at low speeds and low duty cycles, that is, hertz and not kilohertz. Switching times are dictated by the mechanical and thermal properties of the switches. For electro-mechanical actuators such as solenoids, rotary and linear actuators, etc., switching times are generally milliseconds. Liquid metal switches may require time for thermal heating, and electrically driven mechanical valves or actuators may require seconds. As described above, the switches are used to reduce heat loads. The time constants for changing heat loads are typically in seconds. Consequently, these devices are generally used in systems where response times are measured in hertz or sub-hertz, even though the switches may switch much faster. In some circumstances, it is desirable to switch as fast as possible; this usually is during an emergency. For example, there may be a need to protect low temperature circuits. In this situation, the system is designed to act as a circuit breaker opening all current paths or as a crowbar closing all circuit paths, as quickly as possible.

What is claimed is:

1. An electrical lead for connection between a higher temperature and a lower temperature, said lead comprising:

a first buss at said lower temperature, said first buss having a cross-section area A for current flow therethrough;

a second buss at said higher temperature;

n first leads in parallel, each first lead having a first end and a second end and connected at said first end to said first buss, each said first lead having a cross-section area for current flow, the sum of cross-section areas of n−1 of said parallel first leads being less than said cross-section area A;

n second leads in parallel, each second lead having a first end and a second end and connected in parallel at said first end to said second buss, each said lead having a cross-section area for current flow;

a controllable interface unit connected between said first leads and said second leads, said interface unit selectively connecting electrically said second end of any one of 0, 1, 2 . . . n of said n first leads to said second end of a respective one of said n second leads, in use current flowing between said busses through said connected first and second leads, in use heat flowing from said second higher temperature buss to said first lower temperature buss through said connected leads, said interface unit selectively disconnecting said connected leads electrically with a physical gap between said second ends of said disconnected leads, electrical current and conductive heat flow being blocked across said gap.

2. An electrical lead as in claim 1, wherein the sum of cross-section areas of said n first leads is approximately equal to A.

3. An electrical lead as in claim 1, wherein said interface unit includes at least one solenoid actuated electrical switch to connect one of said n first leads to one of said n second leads.

4. An electrical lead as in claim 1, wherein said interface unit includes at least one conductive liquid switch to connect one of said n first leads to one of said n second leads.

5. An electrical lead as in claim 1, wherein said interface unit includes at least one of a linear actuator and a rotational actuator, each actuator having an input terminal and an output terminal and having at least n physical positions for connecting said n first leads to said second leads.

6. An electrical lead as in claim 4, wherein said conductive liquid is selected from a group consisting of mercury, cesium, gallium, and rubidium.

7. An electrical lead as in claim 1, further comprising a main electrical conductor connected between said first buss and said second buss, a cross-section for current flow through said main conductor and through n−1 of said first conductors being less than A.

8. An electrical lead as in claim 1, wherein said lower temperature is cryogenic and said first buss is at least one of thermally insulated and maintained in a thermally insulated container.

9. An electrical lead as in claim 1, wherein said interface unit is maintained in a vacuum in an insulated container, said first leads extending to said insulated container, said vacuum reducing convective heat transfer to said first leads from said higher temperature.

10. A method for reducing heat transfer through an electrical lead that extends between a higher temperature and a lower temperature, comprising the steps:

a) splitting a first buss, having a current flow cross section A, at said lower temperature into n parallel first leads;

b) splitting a second buss at said higher temperature into n parallel second leads;

c) making the sum of cross-sections for current flow of n−1 of said n first leads less than the cross-section A of said first buss;

d) providing an interface unit between said first and second leads that in use selectively, and electrically can connect each said first lead to a respective one of said second leads;

e) providing a physical gap between unconnected first and second leads at said interface unit, said gap blocking electrical current and conductive heat transfer through said unconnected leads;

f) varying the quantity of said connected leads to make the sum of current flow cross section areas of said connected leads vary directly with the current flow through said interface unit, in use said current flow area ranging from 0 to approximately A as total current ranges from 0 to a maximum value through said first and second leads.

11. A method as in claim 10, wherein said interface unit in use connects any one of 0, 1, 2 . . . n of said first leads to said respective second leads.

12. An electrical lead for connection between a higher temperature and a lower temperature, said lead comprising:

a first buss at said lower temperature, said first buss having a cross-section area A for current flow there through;

a second buss at said higher temperature;

n first leads in parallel, each first lead having a first end and a second end and connected at said first end to said first buss, each said first lead having a cross-section area for current flow;

n second leads each second lead having a first end and a second end and connected at said first end to said second buss, each said second lead having a cross-section area for current flow;

a controllable interface unit for selectively connecting first leads each to a respective second lead at said second ends, the quantity of connected leads being variable in use in said interface unit in direct relationship to a magnitude of electrical current flowing through said first and second leads and said busses, a sum of cross section areas of connected first leads for any range of buss current being equal to or less than approximately A, unconnected first and second leads having a physical gap between said second ends, current and conductive heat flow being blocked across said gap, in use a sum of said connected current flow area in said interface unit ranging from 0 to approximately A as total current ranges from 0 to a maximum value through said first and second leads.

13. A method for reducing heat transfer through an electrical lead that extends between a higher temperature and a lower temperature, comprising the steps:

a) splitting a first buss, having a current flow cross section A, at said lower temperature into n parallel first leads;

b) splitting a second buss at said higher temperature into n parallel second leads;

c) making the respective cross-sections for current flow of said n first leads not greater than the cross-section A approximately of said first buss;

d) providing an interface unit between said first and second leads that in use selectively, and electrically can connect each said first lead to a respective one of said second leads;

e) providing a physical gap between unconnected first and second leads at said interface unit, said gap blocking electrical current and conductive heat transfer through said unconnected leads;

f) varying the quantity of said connected leads to make the sum of current flow cross section areas of said connected leads vary directly with the current flow through said interface unit, in use a sum of said current flow area ranging from 0 to approximately A as total current ranges from 0 to a maximum value through said first and second leads.

14. A method as in claim 13, wherein said interface unit in use connects any one of 0, 1, 2 . . . n of said first leads to said respective second leads.

* * * * *